US006079305A

United States Patent [19]

Bloch et al.

[11] Patent Number: 6,079,305

[45] Date of Patent: Jun. 27, 2000

[54] ROLLED WEB DISPENSER AND CUTTING APPARATUS

[75] Inventors: Nathan D. Bloch, Cherry Hill, N.J.; Alan D. Frazier, West Chester, Pa.; Edward J. O'Brien, Easthampton, N.J.

[73] Assignee: Kimberly-Clark Worldwide, Inc., Neenah, Wis.

[21] Appl. No.: 08/870,099

[22] Filed: Jun. 5, 1997

Related U.S. Application Data

[63] Continuation of application No. 08/206,781, Mar. 4, 1994, abandoned.

[51] Int. Cl.[7] ..... B23D 25/02; B65H 16/02

[52] U.S. Cl. ..... 83/335; 83/649

[58] Field of Search ..... 83/649, 650, 396, 83/436.3, 648, 335; 225/106, 14, 16, 12; 226/183; 242/564.1, 564.3, 564.4, 566, 615

[56] References Cited

U.S. PATENT DOCUMENTS

| | | | |
|---|---|---|---|
| 3,739,965 | 6/1973 | Jespersen et al. | 225/96 |
| 3,896,691 | 7/1975 | Granger et al. | 83/335 |
| 3,998,120 | 12/1976 | Granger et al. | 83/335 |
| 4,122,738 | 10/1978 | Granger | 83/314 |
| 4,142,431 | 3/1979 | Jespersen | 83/335 |
| 4,176,569 | 12/1979 | DeLuca . | |
| 4,188,844 | 2/1980 | DeLuca | 83/337 |
| 4,203,562 | 5/1980 | DeLuca et al. | 242/560.1 |
| 4,206,858 | 6/1980 | DeLuca et al. | 225/96 |
| 4,213,363 | 7/1980 | Granger | 83/298 |
| 4,276,797 | 7/1981 | Baumann et al. | 83/308 |
| 4,286,489 | 9/1981 | DeLuca | 83/335 |
| 4,307,638 | 12/1981 | DeLuca et al. | 83/37 |
| 4,307,639 | 12/1981 | DeLuca | 83/337 |
| 4,340,195 | 7/1982 | DeLuca | 242/560 |
| 4,404,880 | 9/1983 | DeLuca | 83/42 |
| 4,432,261 | 2/1984 | DeLuca | 83/37 |
| 4,441,392 | 4/1984 | DeLuca | 83/337 |
| 4,552,315 | 11/1985 | Granger | 242/560.3 |
| 4,621,755 | 11/1986 | Granger | 225/96 |
| 4,635,837 | 1/1987 | Granger | 225/96 |
| 4,712,461 | 12/1987 | Rasmussen | 83/334 |
| 4,846,035 | 7/1989 | Granger | 83/337 |
| 5,048,386 | 9/1991 | DeLuca et al. | 83/37 |
| 5,441,189 | 8/1995 | Formon | 225/106 |

FOREIGN PATENT DOCUMENTS

WO9214590 9/1992 WIPO .

*Primary Examiner*—Rinaldi I. Rada
*Assistant Examiner*—Dominic J. Troiano
*Attorney, Agent, or Firm*—Karl V. Sidor

[57] ABSTRACT

A roll towel dispenser is operative to deliver and sever sheets of web from a roll of towel. The dispenser comprises a housing defining a compartment in which the roll of towel is maintained. A drive roller is supported by a frame attached to the housing. Cutting means interconnected with the drive roller operate to sever a sheet of web from the roll of material in predetermined lengths. First and second guide rollers, each supported by the frame, form respective nips with the drive roller. The drive roller is driven by the action of a user pulling on a tail of the roll, which passes through the nips and extends from the housing. A plurality of guide clips, each attached to the guide rollers at aligned annular grooves defined therein, encircle a peripheral segment of the drive roller. The guide clips function to bias the first and second guide rollers toward the drive roller and assist in threading the roll towel through the nips.

21 Claims, 9 Drawing Sheets

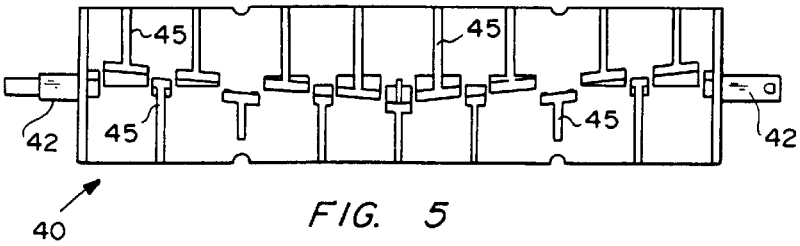
FIG. 5
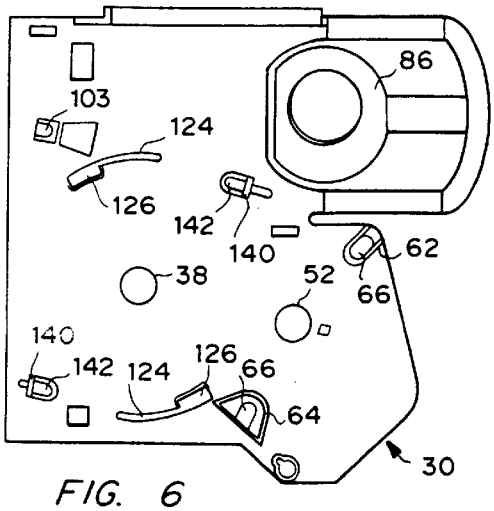
FIG. 6
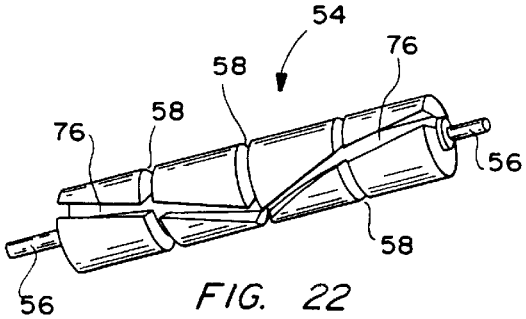
FIG. 22
FIG. 20
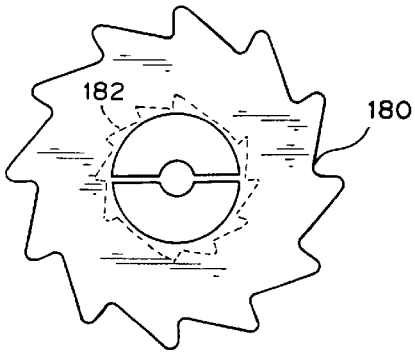
FIG. 7
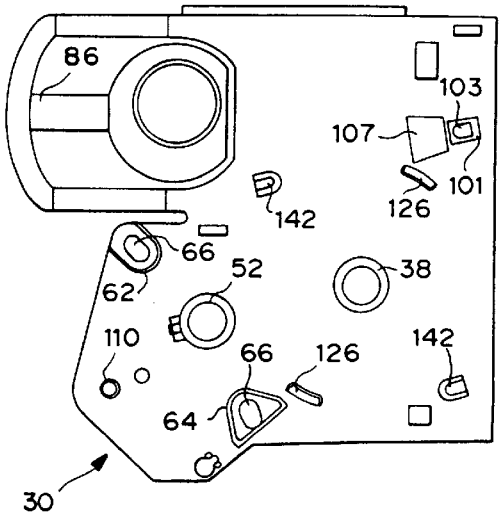

FIG. 8
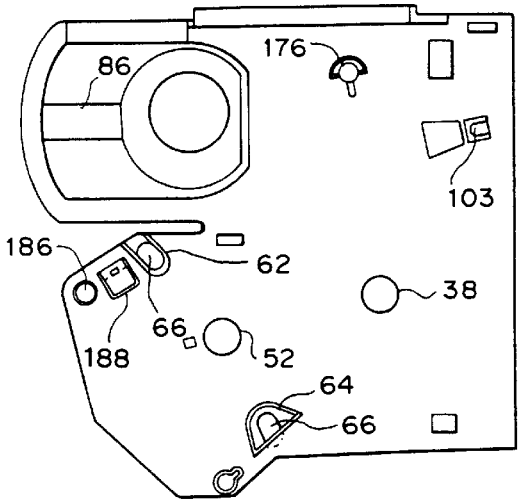
FIG. 13
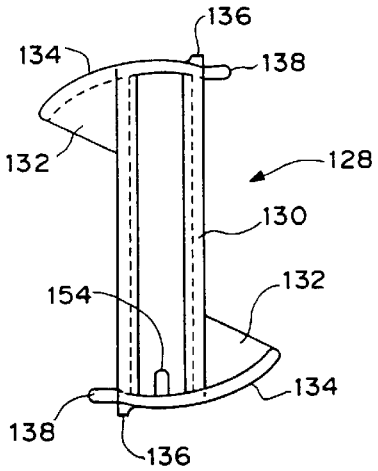
FIG. 9
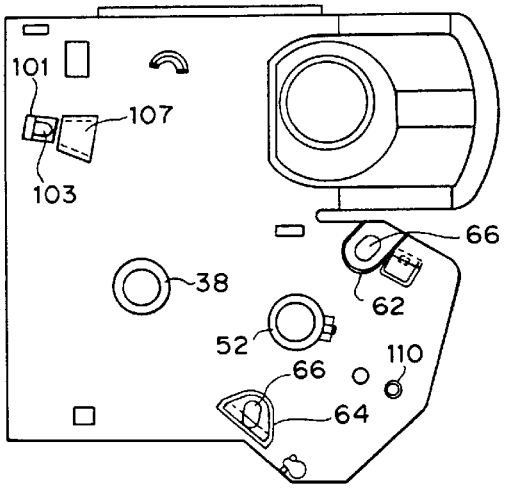
FIG. 17
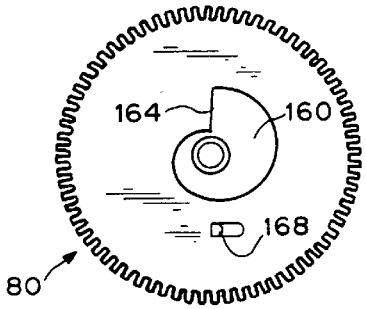
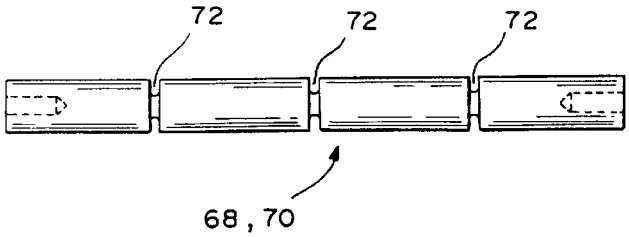
FIG. 10

ROLLED WEB DISPENSER AND CUTTING APPARATUS

The application is a continuation of application Ser. No. 08/206,781 entitled "Rolled Web Dispenser and Cutting Appartus" and filed in the U.S. Patent and Trademark Office on Mar. 4, 1994, now abandoned. The entirety of this Application is hereby incorporated by reference.

BACKGROUND OF THE INVENTION

1. Field of the Invention

The present invention relates generally to dispensing a rolled paper product, and more particularly, to a rolled paper dispenser which automatically severs or partially severs the rolled web into sheets as the web is dispensed.

2. Brief Description of the Prior Art

There are a number of dispensers known in the prior art for dispensing and cutting paper towels. Many of such dispensers include a serrated edge against which the tail of the rolled paper can be pulled to effect a tear.

Also known in the prior art are apparatus wherein the user pulls the tail of the rolled paper towel and the towel is automatically severed and a pre-determined length as it is dispensed. These dispensers are typically referred to as no-touch dispensers. Examples of these types of apparatus are shown in U.S. Pat. No. 4,122,738 and U.S. Pat. No. 4,213,363, both to Granger. The apparatus taught in such patents include the rotating drum having a cutting means pivotally mounted within the drum. As the tail of the paper towel is pulled across the drum, the drum is caused to rotate and the rotation of the drum simultaneously rotates a cam which causes the cutting member to pivot out through a slot in the drum and sever the paper towel.

A modification of the above described Granger towel dispensers is disclosed in U.S. Pat. No. 4,635,837 also to Granger. The paper towel dispenser described in such patent includes a shaft mounted for free rotation at the lower opening of the dispenser for guiding the paid off web and for preventing unintentional engagements with the user's fingers. The shaft is provided with a circumferential groove as is the drum allowing for the resident of a drive belt therein. The rotating drum again includes cutting means pivotally mounted within the drum with such cutting means divided at these two separate half blades to avoid interference with the belt.

U.S. Pat. No. 4,712,461 to Rasmussen teaches yet another rolled web dispenser which automatically severs the web at a predetermined length when the user pulls on the tail of the rolled web. Rasmussen employs a cutting blade adapted to reciprocate within a rotating drum such that the blade extends through the slot in the drum surface at a predetermined location. Pins extending from the ends of the blade reside in slots in the end of the drum to govern the direction of the blade movement. A cam follower extending from two of the pins cooperates with a stationary cam to create the reciprocating motion.

Nothing in the prior art teaches a no-touch dispenser wherein the cutting blade is unaccessible even when the cabinet is opened. In such manner, the danger of anyone cutting their fingers on the cutting blade even while filling the dispensers with towels is eliminated.

SUMMARY OF THE INVENTION

It is therefore an object of the present invention to provide a rolled web dispensing apparatus wherein when the user pulls a tail of the rolled paper towel, the towel is automatically severed at a pre-determined length leaving several connecting tabs.

It is a further object of the present invention to provide for the safety of users and maintenance personnel by rendering the cutting blade inaccessible even when the cabinet is opened.

It is a further object of the present invention to provide a no-touch dispenser including means to obtain a low activation force delivery system which allows for wet handed dispensing without tab out.

These and numerous other features, objects and advantages of the present invention will become readily apparent upon reading the detailed description, claims and drawings set forth hereinafter. Briefly stated, these features, objects and advantages are accomplished through the use of a perf-type cutting blade which is bent or formed of two segments such that it is V or chevron shaped with each segment projecting from the cutting blade support in a substantially helical pattern. The cutting blade is supported on a rotatable axle and is geared to rotate in conjunction with a drive drum which includes a V or chevron shaped slot therein which interfaces with the cutting blade. The cutting blade itself is shielded from the remainder of the dispenser by means of a fixed cowl which, in combination with the dispenser cabinet and the drive drum, blocks all access to the blade even when the dispenser is opened for maintenance purposes to insert a fresh roll of paper towels. A pair of guide rollers are rotatably mounted adjacent the drive drum. Each of the guide rollers and the drive drum include annular slots. A threading clip is attached to each guide roller at these annular slots with each threading clip extending from one guide roller around the drive drum to the other guide roller. The threading clips ensure that the paper towel when first inserted into the overall mechanism will be routed correctly through the drive drum/blade/guide roller assembly. The threading clips also ensure proper tensioning of the web through the mechanism which is necessary for cutting the web.

A braking mechanism is provided which relies on a cam mounted to the gear of the cutting blade. As the cutting blade is rotated, the cam drives the cam follower which lifts a spring loaded piston placing a travel stop temporarily in the path of a projection from one side of the gear. The projections ram the travel stop and the shock is absorbed by springs. The brake mechanism thus ensures that the rolled towel cannot be free spooled by a user of the dispenser. The brake mechanism also creates a positive stop of the rotation of the web roll to allow a user to break the tabs connecting the sheet to the remainder of the roll after the cut has been made.

The dispenser of the present invention is designed to be a no-run-out dispenser and includes supports therein for both a primary roll and a stub or remnant roll of towel. Geared sensor arms are provided which sense the diameter of the stub or remnant roll. As the diameter of that roll decreases such that it has only a few linear feet of towel left thereon, the tail from the primary roll is automatically delivered to the surface of the drive drum and the proximity of the upper guide roller and the paper is automatically threaded therethrough.

To dispense a rolled towel product from the dispenser of the present invention, the user need merely grasp the tail of the towel extending from the dispenser and pull downward. This action drives the drive drum which in turn rotates the cutting blade into position severing the sheet at the proper location. Because the blade is spring loaded, the user is pulling against the force of the spring to the point at just before where the cut is begun. At that point, the spring unloads helping with the cut and kicking out a tail for the next towel to be grasped.

BRIEF DESCRIPTION OF THE DRAWINGS

FIG. 5 is a plan view of the cutting blade holder.

FIG. 6 is an outside face side elevation of the left side plate.

FIG. 7 is an inside face side elevation of the left side plate.

FIG. 8 is an outside face side elevation of the right side plate.

FIG. 9 is an inside face side elevation of the right side plate.

FIG. 10 is a plan view of a guide roller (typ.).

FIG. 13 is a side elevation of the shock absorbing member.

FIG. 17 is a side elevation of the spur gear from the jumping cam thereof.

FIG. 20 is a side elevation of the hand wheel.

FIG. 22 is a perspective view of the drive drum.

DETAILED DESCRIPTION OF THE PREFERRED EMBODIMENT

Figure 1:
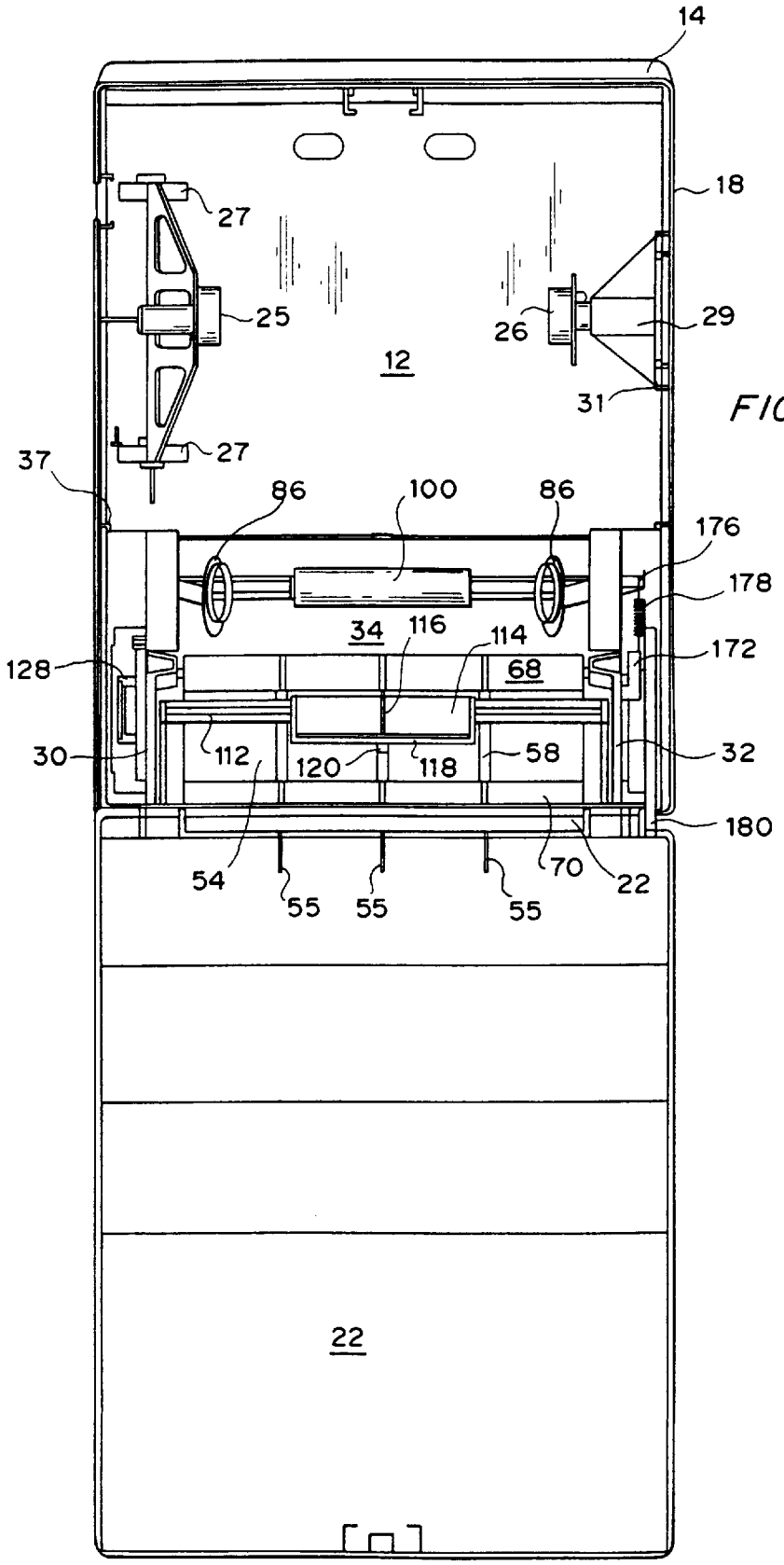
FIG. 1 is a front elevational view of the dispenser of the present invention with the front housing in the open position.
Figure 2:
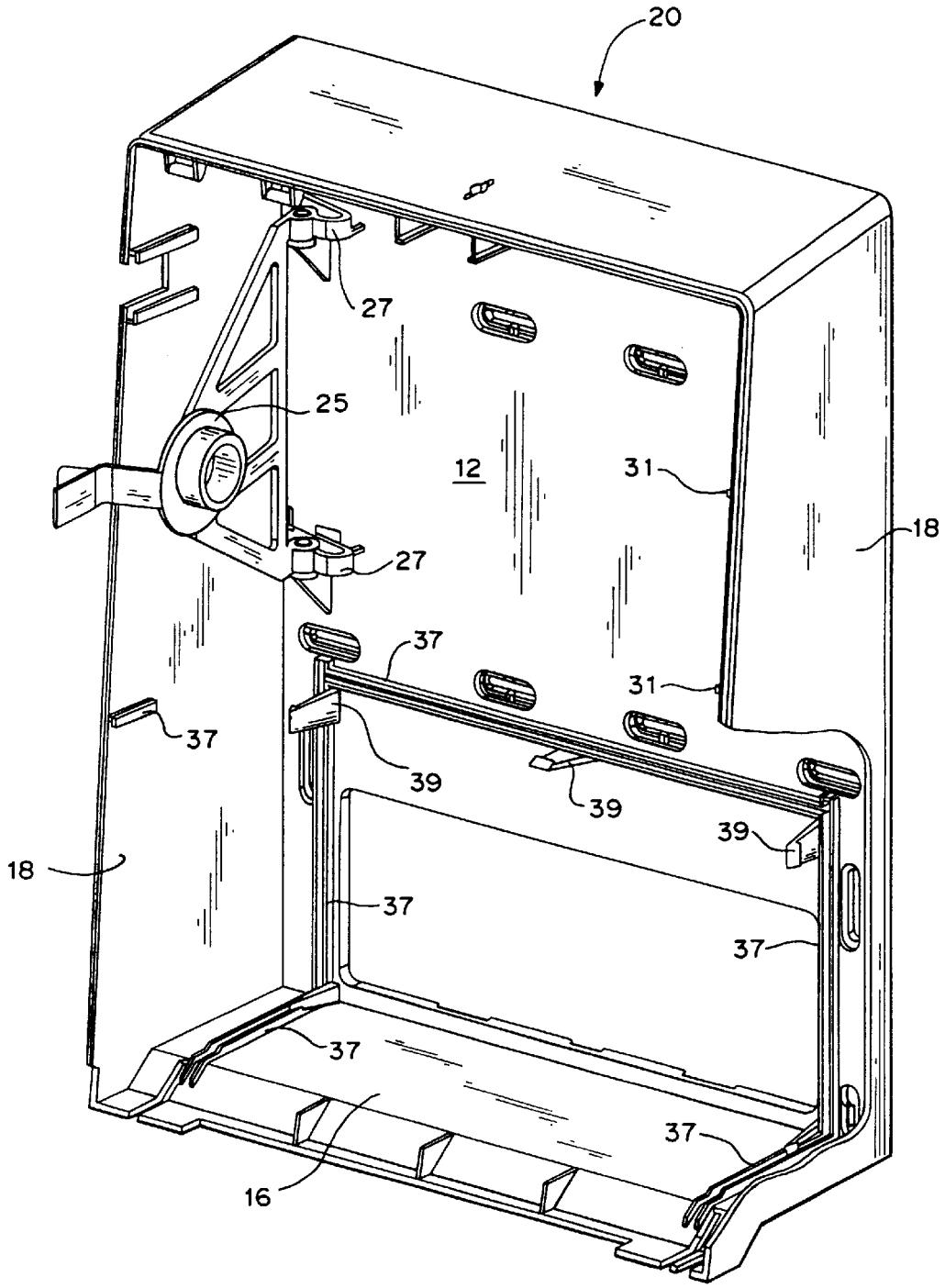
FIG. 2 is a partially cutaway perspective view of the rear housing with the dispensing mechanism removed therefrom.

Turning first to FIGS. 1 and 2, there is shown the no-touch roll towel dispenser 10 of the present invention which includes a rear wall 12 for mounting to a vertical supporting surface such as a lavatory wall. Extending from rear wall 12 are top wall 14, bottom wall 16, and side walls 18. Rear wall 12, top wall 14, bottom wall 16 and side walls 18 form a rear housing 20. Pivotally connected to rear housing 20 is door or front housing 22. The dispensing slot 24 is located toward the bottom of door 22.

Referring specifically to FIG. 2, there is shown the rear housing 20 of the present invention with the door 22 removed therefrom. Mounted within the upper portion of dispenser 10 are left primary roll holder 25 and right primary roll holder 26 which supports the primary roll of towel (not shown). Left primary roll holder 25 is pivotally mounted with leaf springs 27 biasing it away from left side wall 18. Right primary roll holder 26 extends telescopically from bracket 29 attached to right side wall 18. Bracket 29 slidingly engages right side wall 18 by means of rails 31. A coil spring biases right primary roll holder 26 toward left primary roll holder 25. Extending from primary roll holder 25 is positioning arm 33". Positioning arm 33 is contacted by the inside surface of front housing 22 when front housing 22 is closed on rear housing 20. Thus, the left side of the primary roll of towel is always set in the same place allowing primary roll holder 26 to float depending on the width of the roll being dispensed. In such manner, the primary roll holders 25, 26 automatically adjust to support roll of varying width. Mounted below primary roll holders 25 and 26 are left side plate 30, right side plate 32, and blade cover or cowl 34, which interconnect with one another to form a frame for supporting the dispensing mechanism. The frame is an interlocking-type structure which slide mounts into railings 37 extending from the inside of rear housing 20 (see FIG. 2). Catches 39 are provided to snap-fit or lock the frame in place. Blade cover or cowl 34 includes a notch 35 on each side thereof.

Figure 3:
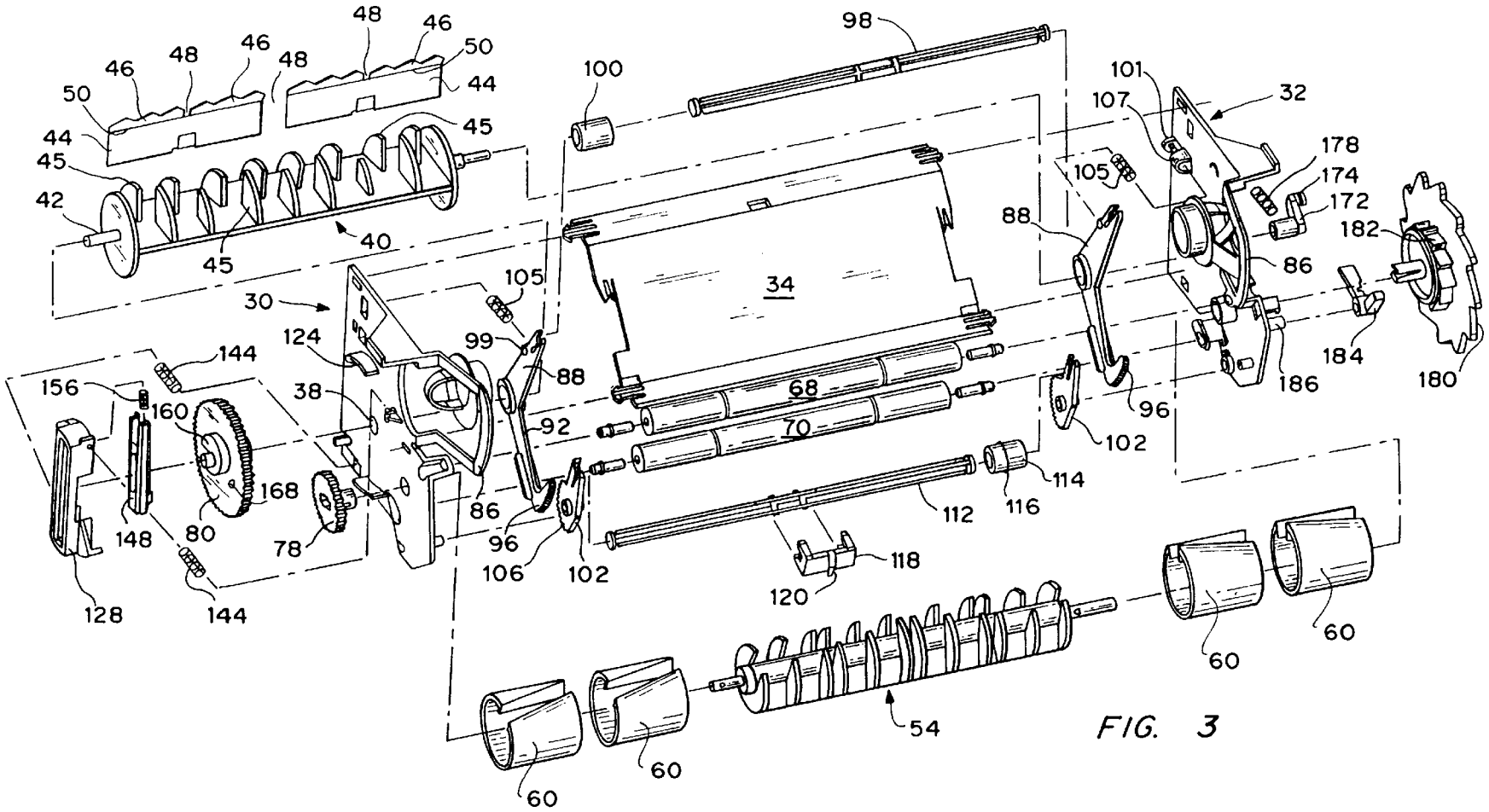
FIG. 3 is an exploded perspective view of the dispensing mechanism.
Figure 4:
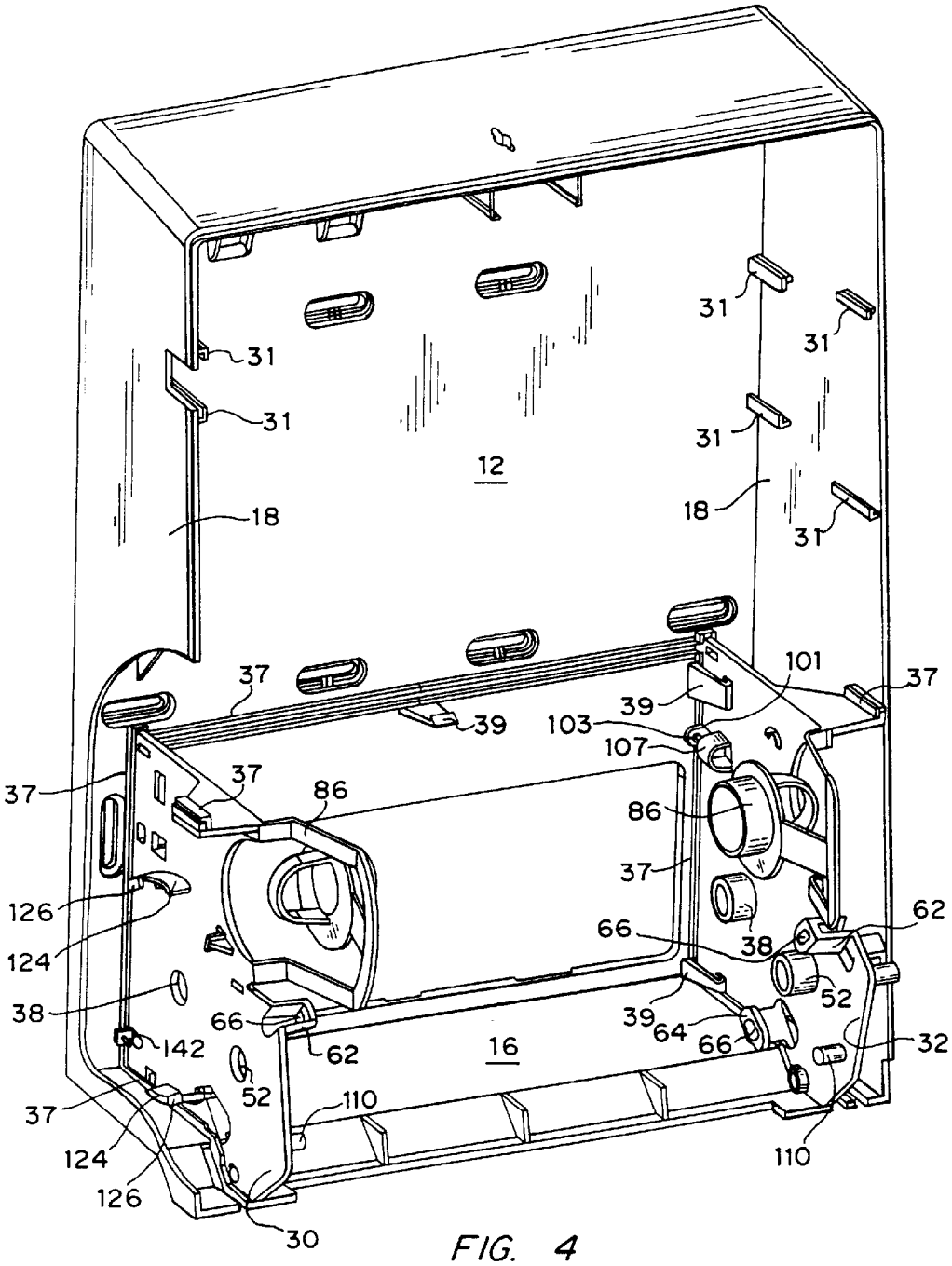
FIG. 4 is a partially cutaway perspective view of the side panels mounted in the rear housing.
Figure 18:
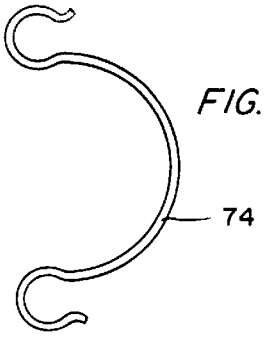
FIG. 18 is a detail drawing of a guide clip.
Figure 21:
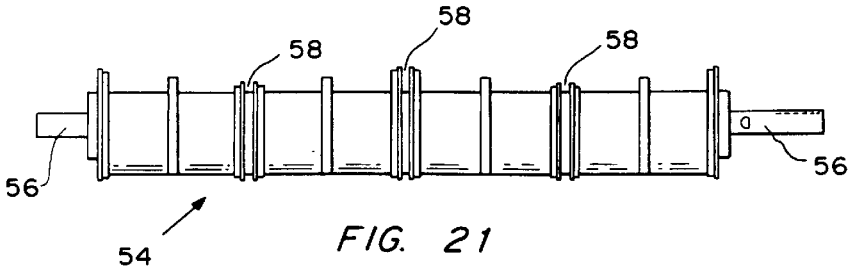
FIG. 21 is a plan view of the drive drum with the tubular members removed therefrom.
Figure 23:
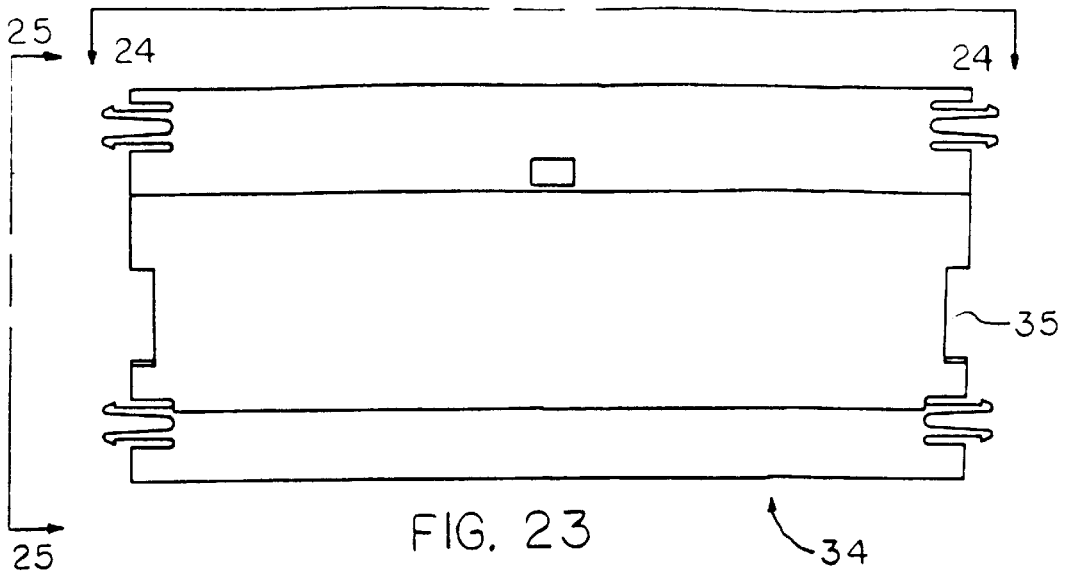
FIG. 23 is a top plan view of the blade cover.
Figure 24:
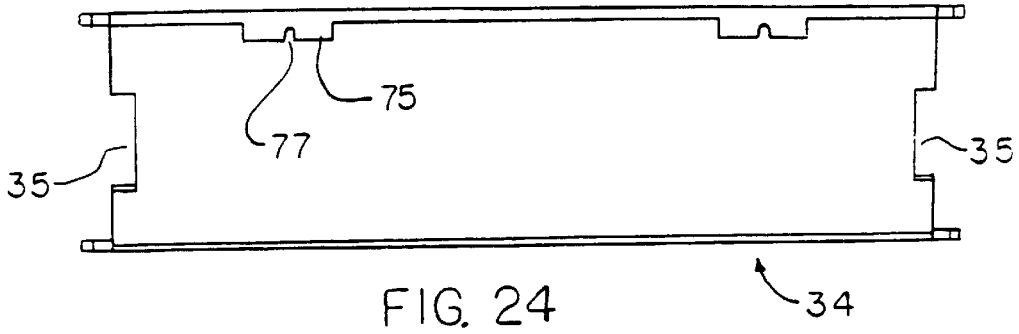
FIG. 24 is a rear elevational view of the blade cover taken along line 24—24 of FIG. 23.
Figure 25:
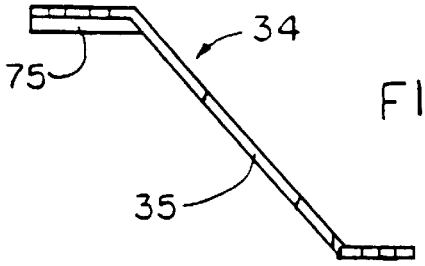
FIG. 25 is a side elevational view of the blade cover taken along line 25—25 of FIG. 23.

Left side plate 30 and right side plate 32 (see FIGS. 3, 4, and 6 through 9) each include a bore therethrough defining a journal bearing 38". There is a cutting blade support member 40 (see FIGS. 3 and 5) which extends from the left side plate 30 to right side plate 32. Cutting blade support member includes a journal 42 extending from each end thereof. Journals 42 reside in journal bearings 38 such that cutting blade support member 40 is rotatably supported. Extending from cutting blade support member 40 are the two segments of cutting blade 44. Cutting blade support member 40 includes a plurality of opposing fingers 45 which are offset from one another. Cutting blade 44 is held between opposing fingers 45 of cutting blade support member 40 in such manner that cutting blade 44 projects from cutting blade support member 40 in two spiraled segments to form a generally flat chevron or V-shape. (Note that fingers 45 are shown in greater detail in FIG. 5 than in FIG. 3.) The segment of cutting blade 44 includes a plurality of teeth 46 arranged in groups of three. Cutting blade 44 also includes a plurality of slots 48 which are located between adjacent groups of three teeth and which provide clearance between the blade 44 and the threading clips 74 (shown in FIG. 18) during rotation of the cutting blade. The greater the number of teeth 46 extending from cutting blade 44, the greater the force needed to cut the web and smoother is the line of cut imparted to the web. A lesser number of teeth 46 results in a lower force needed to make the cut, but also results in a more jagged line of cut.

Cutting blade 44 includes a bend 50 therein angling the teeth 46 in the direction in which cutting blade support member 40 rotates, that being in the direction of the travel of the web through the dispenser 10. The angle of bend 50 in cutting blade 44 is preferably about 27°. Angling of the blade is preferred for dispensing operation. However, such a bend 50 in the blade 44 may have a tendency to cause jamming of the dispenser during threading of a new roll through the mechanism. To reduce the potential for jamming during threading it is preferred that there be no bend 50 in the blade 44.

Spaced away from journal bearings 38 in left and right side plates 30, 32, and extending inwardly therefrom are journal bearings 52. There is a drive drum or roller 54 which has a drive roller journal 56 extending from each end thereof. (See FIGS. 1, 3, 21, and 22.) Each drive roller journal 56 rotatably resides within a journal bearing 52. Drive drum or roller 54 includes a plurality of annular slots 58 therein. A plurality of stripping fins 55 (see FIG. 1) extend from the bottom of door 22. When door 22 is closed, stripping fins 55 extend into annular slots 58 ensuring that as the web is taken around drive drum 54, it is removed therefrom at the proper point and caused to exit the dispensing slot 24. Stripping fins 55 thus obviate dispensing jams that can occur when the web fails to exit the dispenser and continues to wrap around the dispensing drum. Drive roller 54 includes a plurality of tubular members 60 which preferably attach by a snap fit arrangement. Affixed to the outside of each tubular member is a friction surface to minimize slipping of the web as it travels about the periphery of the drive drum 54. The friction surface 60 is preferably a relatively dense elastomer. Each tubular member 60 should be capable of locking into a single orientation on drive drum 54.

Extending from the inside surfaces of left and right side plates 30, 32 are upper brackets 62 and lower brackets 64. Each of the upper brackets 62 and lower brackets 64 includes a slotted opening 66. Residing between upper brackets 62 and supported thereby is upper guide roller 68. Residing between lower brackets 64 and supported thereby is lower guide roller 70. Upper guide roller 68 and lower guide roller 70 each have a plurality of annular grooves 72 therein (see FIG. 10). The annular grooves 72 in upper and lower guide rollers 68, 70 are in alignment with each other. Guide clips 74 (See FIG. 18; not shown in FIG. 3) attach to upper and lower guide rollers 68, 70 at annular grooves 72 with each guide clip extending about the outside of drive roller 54. Guide clips 74 are preferably made of steel and gently bias upper and lower guide rollers toward drive roller 54. Each guide clip 74 extends from upper guide roller 68 to lower guide roller 70 wrapping about the outside of drive roller 54 in the direction of rotation of drive roller 54. Preferably, the gap between guide clips 74 and friction surface 60 is in the range from about 1/16" to about 1/8". The guide clips 74 guide the web in the proper path around drive roller 54 during threading. The nips between the drive roller 54 and the upper and lower guide roller 68, 70 maintains the web in tension as it traverses the periphery of the drive roller 54. This tension is important to ensure that the web is cut or perforated by blade 44 entering slot 76. The blade 44 enters slot 76 to cut the web when the rotation of drive roll 54 has positioned slot 76 such that it is located between upper and lower guide rollers 68, 70 along the path of the web. Without such tension the web may merely be pushed into slot 76 and remain uncut. The annular grooves 72 in upper and lower guide rollers 68, 70 are preferably wide enough to allow the guide clips 74 to fit therein without pressing against the sides of the grooves. The intent is to reduce frictional forces between the guide clips 74 and the upper and lower guide rollers 68, 70 which, in turn, reduces the force necessary to rotate upper and lower guide rollers 68, 70. In such manner, the guides clips will not significantly increase the drag forces on the web as it is drawn through the mechanism of the dispenser 10. However, a loose fit between the guide clips 74 and the annular grooves 72 may allow the clips to cant such that the plane in which a guide clip 74 resides is no longer perpendicular to the axes of rotation of the upper and lower guide rollers. If the guide clips 74 shift to too great a degree in annular grooves 72, the guide clips 74 may go out of alignment with slots 48 in blade 44 causing an interference between the blade 44 and the guide clips 74. This situation is obviated by guide clip positioners 75 which are preferably integrally formed with blade cover 34. Guide clip positioners 75 each include a notch 77 into which a portion of a respective guide clip 74 inserts. Each guide clip 74 is thereby supported at three points and is thus not subject to any significant wobble or canting.

Drive roller 54 has a chevron or V-shaped slot 76 therein which is actually comprised of non-linearly aligning (spirally aligning) slots in each of the tubular members 60. There is a drive gear 78 which attaches to a drive roller journal 56 on the left side of the drive roller 54 on that portion of the drive roller journal 56 which extends beyond left side plate 30. Drive gear 78 meshes with spur gear 80 which is affixed to the journal 42 and extends beyond left side plate 30. The ratio of the drive gear 78 to the spur gear 80 is such that for every two rotations of drive drum 54, cutting blade support member 40 rotates once with cutting blade 44 inserting into chevron shaped slot 76.

Figure 11:
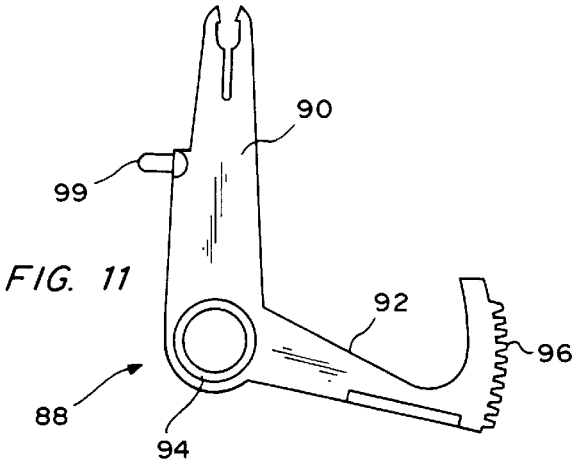
FIG. 11 is a side elevation of a first rocker arm (typ.).

The dispenser 10 of the present invention also includes an automatic transfer mechanism which automatically feeds the tail from primary roll (not shown) to the nip between drive roller 54 and upper guide roller 68 when stub roll (not shown) is almost spent. A stub roll 84 is supported on stub roll brackets 86 extending from left and right side plates 30, 32. The automatic transfer mechanism includes a pair of first rocker arms 88, one of such first rocker arms 88 being located at each end of cutting blade support member 40. Referring to FIG. 11 for detail of first rocker arms 88, each first rocker arm 88 includes a sensor support member 90 and a gear member 92. There is a journal bearing 94 located substantially at the intersection of sensor support member 90 with gear member 92. Each gear member 92 includes a plurality of gear teeth 96 on the distal end thereof. Extending across sensor support members 90 and affixed thereto is sensor rod 98. Rotatably mounted on sensor rod 98 is sensor roller 100. Each sensor support member 90 has a prong 99 extending therefrom. There is a bracket 101 extending from the inside surface of left and right side panels 30, 32 in general alignment with prongs 99. Projecting from brackets 101 toward prong 99 is a second prong 103. Coil springs 105 fit over prongs 99, 103 and extend therebetween to thereby bias sensor support members 90 and sensor rod 98 toward the stub roll. A U-bracket 107 may be provided on the inside surface of left and right side panels 30, 32 to ensure that coil springs 105 remain properly aligned. Sensor support members 90 extend through blade cover 34 at notches 35. Sensor roller 100 is free to rotate on sensor rod 98 and thus reduces drag on the web generated by the force of coil springs 105 biasing the sensor support members 90 and the sensor rod 98 toward the stub roll.

Figure 12:
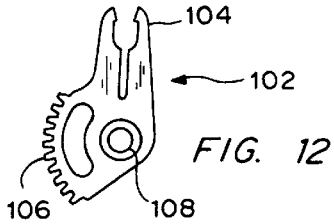
FIG. 12 is a side elevation of a second rocker arm (typ.).

Automatic transfer mechanism also includes second rocker arms 102. Looking at FIG. 12 for detail, each second rocker arm 102 includes a transfer rod support member 104, a geared surface 106 and a journal bearing 108. Second rocker arms 102 are supported on pins 110 extending from the inside surfaces of left and right side plates 30, 32. There is a transfer rod 112 which is affixed at each end to one of the transfer rod support members 104. Rotatably supported on transfer rod 112 is transfer roller 114. Transfer roller 114 rotates freely on transfer rod 112 and thus reduces drag on the web at the nip between the transfer rod/transfer roller 112, 114 and the drive roll 54. Transfer roller 114 includes an annular projection 116 which aligns with the annular slot 58 located substantially at the midpoint of drive roller 54, and the annular groove 72 located substantially at the midpoint of upper guide roller 68. There is a channel bracket 118 attached to transfer rod 112 extending around transfer roller 114. Projecting from channel bracket 118 is a pin 120. When the primary roll is first loaded, the tail of the primary roll is taken beneath upper guide roller 68, wrapped partially thereabout and impaled on pin 120. The geared surfaces 106 of second rocker arms 102 mesh with the gear teeth 96 of the first rocker arms 88.

The automatic transfer system operates such that coil spring 105 bias sensor support members 90 and sensor rod 98 to pivot about journal bearings 94 to thereby maintain sensor roller 100 in contact with the outside surface of the stub roll which is supported by stub roll brackets 86. As the stub roll is deplenished, the concomitant rotational movement of sensor support members 90 results in rotational movement of gear members 92. With gear teeth 96 intermeshing with geared surface 106 of transfer rod support member 104, rotational movement is also imparted to second rocker arms 102 pivoting about journals 108. Thus, as the stub roll is deplenished, transfer rod support member 104 is driven closer toward the nip between drive roller 54 and upper guide roller 68. When the stub roll is nearly spent, transfer roller 114 is pressing the tail of the primary roll against drive roller 54 in close proximity to the nip between drive roller 54 and upper guide roller 68. Annular projection 116, which aligns with the center annular slot 58 on drive roller 54 and with the center annular groove 72 on upper guide roller 68, actually enters into such slot 58 and the groove 72 when the stub roll is sufficiently depleted. This action ensures that the tail of the primary roll will be pinched in the nip between the drive roller 54 and the upper guide roller 68 and drawn therein. Once the web is grasped by the nip, it is torn from pin 120 and dispenses simultaneously with the remaining web on the stub roll. When the stub roll is fully spent, then the web from primary roll is dispensed alone. At that point in time when primary roll has sufficiently decreased in diameter, it can be relocated to be supported on stub roll brackets 86 with a new primary roll inserted on primary roll holders 26.

Travel stop means (not shown) should be provided to limit the amount of rotation available to first rocker arms 88 and second rocker arms 102. Over rotation could allow gear teeth 96 to disengage from geared surface 106.

Figure 15:
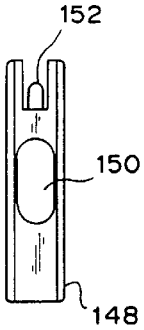
FIG. 15 is an outside face side elevation of the piston.
Figure 16:
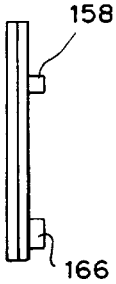
FIG. 16 is a front elevation of the piston.
Figure 14:
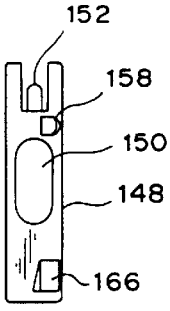
FIG. 14 is an inside face side elevation of the piston.

The dispenser 10 of the present invention further includes a braking mechanism. The braking mechanism includes a pair of arcuate brackets 124 extending from left side plate 30. Each arcuate bracket 124 includes a retaining clip 126. Residing between arcuate brackets 124 is a shock absorbing member 128 (shown alone in FIG. 13) which is adapted for intermittent rotational movement about journal 42. Shock absorbing member 128 includes a shaft 130 having a gusset 132 extending from each end thereof. Projecting perpendicularly from gusset 132 is radiused ledge 134. Extending from one end of each radiused ledge 134 is a travel stop 136 which normally resides abutting one end of an arcuate bracket 124. Retaining clips 126 extend radially inwardly from arcuate brackets 124 adjacent to gussets 132 to prevent shock absorbing member 128 from being laterally extracted off journal 42 when shock absorbing member 128 is in an operable position. Extending from shock absorbing member 128 proximate to travel stops 136 and substantially perpendicular thereto are shanks 138. Extending out from left side plate 30 are spring supports 140 which have shanks 142 projecting therefrom. Residing between travel stops 136 and spring supports 140 are springs 144 which fit over shanks 138, 142. Residing slidably within shaft 130 is piston 148 (shown in detail in FIGS. 14 through 16). Piston 148 includes an elongate opening 150 therethrough, through which the journal 42 on left side of cutting blade support member 40 inserts. Projecting from one end of piston 148 substantially parallel to shaft 130 is first nipple 152. Projecting from the inside surface of shaft 130 toward and substantially colinear with the first nipple 152 is a second nipple 154. There is a piston spring 156 which resides between piston 148 and the inside surface of shaft 130 retained on first and second nipples 152, 154. Piston spring 156 is in compression thereby biasing piston 148 toward the bottom of shaft 130. Projecting from the inside surface of piston 148 is cam follower 158 (see FIGS. 14 and 16). Cam follower 158 works in conjunction with jumping cam 160 affixed to spur gear 80. Jumping cam 160 is eccentric having a cam surface 162 of increasing radius which is followed by cam follower 158 as cutting blade support member rotates. Cam 160 further includes a radial step 164 where the radius of cam surface 162 abruptly falls from its point of largest radius to its point of smallest radius.

Projecting from the inside surface of piston 148 proximate to the bottom thereof is brake stop 166. Extending from the outside surface of spur gear 80 is gear stop 168.

Figure 19:
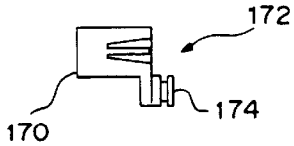
FIG. 19 is a front elevation of the crank.

Affixed to that portion of journal 42 which extends through right side plate 32 is the proximal end 170 of crank 172. (See FIGS. 3 and 19.) Projecting from the distal end of crank 172 is post 174. Extending from the outside surface of right side plate 32 is prop 176. (See FIGS. 3 and 8.) Extending between post 174 and prop 176 is tension spring 178.

A drive roller journal 56 extends through right side plate 32. Affixed thereto outside of side plate 32 and inside of side wall 18 is threading wheel 180. The inside surface of threading wheel 180 has a rachet wheel 182 projecting therefrom. There is a pawl 184 supported on post 186 extending from right side plate 32. Also extending from right side plate 32 substantially adjacent to post 186 is pawl stop 188. Pawl 184 interacts with rachet wheel 182 to ensure that drive roller 54 can be rotated in only one direction. There is a slot 189 in bottom wall 16 through which threading wheel 180 extends allowing a user access thereto even when the front housing 22 is closed on the rear housing 20.

Under normal operation of dispenser 10, the user is presented with a tail of the paper towel projecting through dispensing slot 24 on the bottom front portion of front housing 22. The user grasps the towel and pulls. As the web is pulled from the dispenser around a peripheral segment of the drive roller 54, the drive roller 54 is caused to rotate resulting in the simultaneous rotation of drive gear 78. Drive gear 78 drives spur gear 80 causing cutting blade support member 40 and cutting blade 44 supported thereon to rotate. The ratio of drive gear 80 is such that for every two rotations of drive roller 54, cutting blade support member 40 and cutting blade 44 rotate once. Timing is such that for each rotation of cutting blade support member 40, cutting blade 44 is caused to insert into chevron shaped slot 76, thereby causing a series of large perforations across the web. During rotation of cutting blade support member 40 as cutting blade 44 approaches chevron shaped slot 76, tension spring 178 is loading or being stretched. Thus, the user is pulling against the force of spring 178. Slightly before the time cutting blade 44 is contacting the web and thus entering chevron shaped slot 76, crank 172 has moved approximately 180 degrees from its starting point. At that point, the tension in spring 178 aids in driving the rotation of cutting blade support member 40, and thus, drive drum 54. As the tension in tension spring 178 is unloaded, the added force aids in the cutting blade perforating the web and simultaneously ensures that the drive drum will continue to rotate for a sufficient period to kick out an adequate length of tail for grasping by the next user. Threading wheel 180 has the primary purpose of allowing maintenance people to be able to easily thread a new web through the dispenser. Threading wheel 180 is on the outside of the dispenser in case there has been a dispensing failure such that sufficient tail has not been presented for grasping by the user. In that case, the user can use threading wheel 180 to rotate drive drum 54 to kick out sufficient tail for grasping. Ratchet wheel 182 in combination with pawl 184 ensures that both drive drum 54 and cutting blade support member 40 can rotate in only one direction. This prevents tension spring 178 from inappropriately reversing the rotation of the mechanism.

The braking mechanism of the present invention prevents a user from free spooling paper toweling from the dispenser. In such manner, the user must extract towel from the dispenser in pre-determined lengths. Prior to the grasping of the tail by the user, cam follower 158 will normally be in its at rest position against cam surface 162 at the base of radial step 164. Piston spring 156 biases piston 148 downward to ensure the cam follower 158 follows cam surface 162. As cutting blade support member 40 rotates, cam 160 also rotates. The rotation of cam 160 causes cam follower 158 and thus, piston 148 to move upward within shaft 130 of shock absorbing member 128. As piston 148 moves upward, ultimately, brake stop 166 is moved into alignment with gear stop 168. When cam follower 168 reaches radial step 164, piston 148 falls abruptly within shaft 130. However, if the user is rotating the drive drum too quickly by attempting to remove towel too rapidly from the dispenser, gear stop 168 will ram brake stop 166 thereby momentarily stopping rotation of the drive drum 54 until piston 148 falls within shaft 130 such that cam follower 158 reoccupies its normal at rest position at the base of radial step 164.

The braking system of the present invention also has a shock absorbing system associated therewith. Shock absorbing member 128 is adapted for a small amount of rotation movement within and between arcuate brackets 124. Springs 144 bias shock absorbing member 128 such that travel stops 136 normally have an at rest position abutting one end of arcuate brackets 124. When a user has caused drive drum 54 and cutting blade support member 40 to rotate too quickly thereby causing gear stop 168 to ram brake stop 166, the force of the collision causes shock absorbing member 128 to rotate a small distance against the force of springs 144 thereby absorbing the shock of the collision. Springs 144 quickly return the shock absorbing member 128 to its normal at rest position. Springs 144 in combination with spring supports 140 also provide rotational travel limits for shocking absorbing member 128 in the direction of rotation opposite or against the biasing of springs 144.

It is preferable that all of the enumerated elements of the present invention be made of molded plastic with the exception of the various springs, as well as guide clips 74, cutting blade 44 and friction surface 60 of drive roller 54. Upper and lower guide rollers 68, 70 are preferably made of wood.

It should be recognized that cutting blade 44 is inaccessible by a user of the dispenser 10 and further, is inaccessible even by maintenance personnel who open the door 22 to refill the dispenser 10. Cowl 34 in combination with drive drum 54 blocks all access to blade 44 short of removing the frame formed of left and right side plates 30, 32, and cowl 34 from the dispenser 10. Even rotation of hand or threading wheel 180 while the door 22 is open will not put blade 44 in an accessible position. This negates the possibility of having a user or a maintenance person replacing a spent roll of towel from accidentally cutting or chopping a digit.

Figure 26:
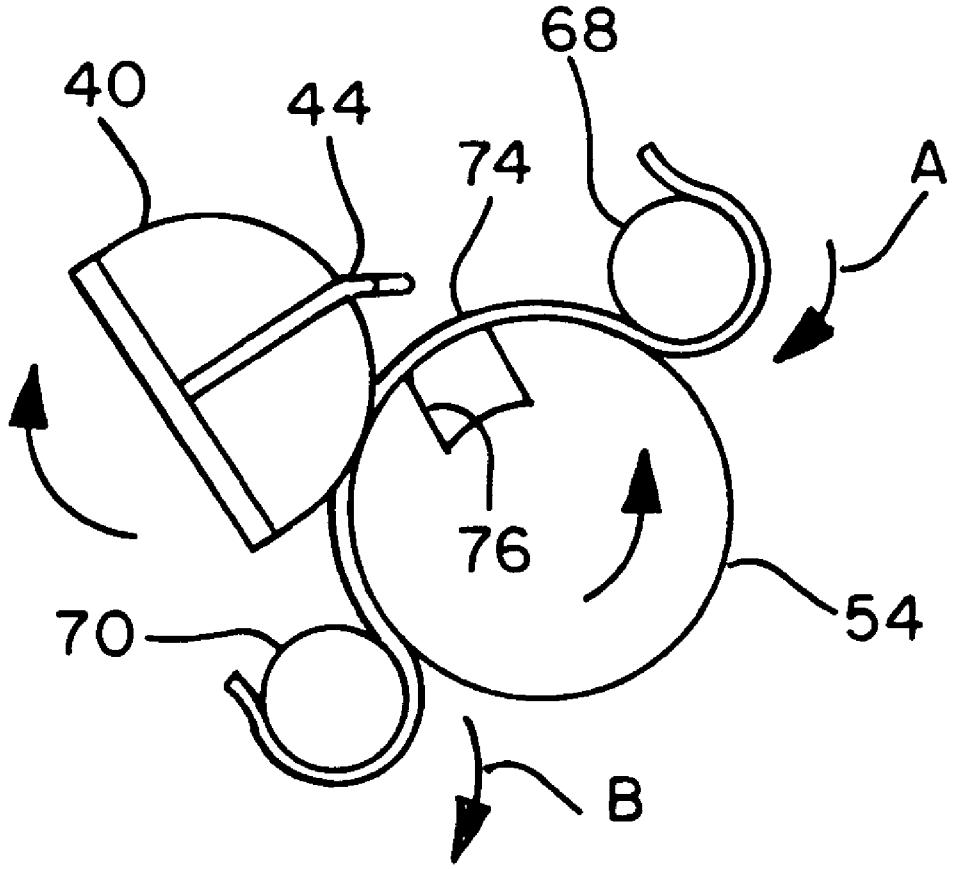
FIG. 26 is a diagrammatic representation showing the positional relationship between the drive roller, guide rollers, cutting blade support member and guide clips.

The positional relationship between drive roller 54 and certain contiguous components is illustrated in FIG. 26. As described above, upper and roller guide rollers 68, 70 form nips with drive roller 54 in which the web material will enter and exit (as indicated by arrows A and B). Rotation of blade support member 40 causes blade 44 to be received in slot 76, causing the web to be desirably cut. Guide clips 74 ensure that the web follows the correct about the outer surface of drive roller 54.

Cutting blade 44 is preferably in a chevron or flattened V-shape in order to ensure that teeth 46 do not contact the tail of the towel at the same time. If all of the teeth 46 were to contact the web at the same time, the force necessary to pull the towel through the dispenser would increase, and further, would promote the towel being pushed into slot 76 rather than being perforated by teeth 46. Cutting blade 44 could also be one continuous spiral rather than V-shaped but then the cut or tear line through the web would have a displeasing angle.

From the foregoing, it should be seen that this invention is one well adapted to attain all of the ends and objects hereinabove set forth together with other advantages which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth were shown in the accompanying drawings is to be interpreted as illustrative and not in a limiting sense.

What is claimed is:

1. A roll towel dispenser for delivering and severing sheets of web from a roll of towel comprising:

(a) a rear housing;

(b) a front housing closable on said rear housing to form a compartment;

(c) a dispensing slot through said front housing;

(d) means for supporting the roll of towel in said compartment;

(e) a frame mounted within said compartment;

(f) a drive roller rotatably supported on said frame, said drive roller having a slot therein;

(g) a cutting blade support member rotatably supported on said frame substantially parallel to said drive roller, said cutting blade support member having a cutting blade extending therefrom;

(h) a first guide roller supported by said frame and a second guide roller supported by said frame, said first guide roller forming a first nip with said drive roller, said second guide roller forming a second nip with said drive roller, said drive roller being driven by the action of a user pulling on a tail of the roll of towel passing through said first and second nips and extending through said dispensing slot;

(i) a drive gear attached to said drive roller;

(j) a spur gear attached to said cutting blade support member, said spur gear operatively connected with said drive gear such that rotation of said drive gear will cause rotation of said cutting blade support member and said cutting blade will be inserted into said slot to perforate the web allowing the user to separate a sheet of the web from the roll of towel;

said first guide roller and said second guide roller each defining at least one annular groove therein, said at least one annular groove of respective of said first guide roller and said second guide roller aligning with one another; and at least one guide clip extending from said first guide roller to said second guide roller so as to encircle a peripheral segment of the drive roller and define a web travel path thereabout, said at least one guide clip being connected to said guide rollers at a respective of said annular grooves.

2. A roll towel dispenser as set forth in claim 1, further comprising a spring-loaded mechanism to facilitate rotation of said cutting blade into said slot of said drive roller.

3. A roll towel dispenser as set forth in claim 1, wherein said cutting blade and said slot in said drive roller are chevron shaped.

4. A roll towel dispenser as set forth in claim 3, wherein said cutting blade includes a plurality of teeth having points at the distal end thereof and which perforate the web as said teeth enter said slot in said drive roller.

5. A roll towel dispenser as set forth in claim 4, wherein said cutting blade is comprised of two segments, each of said segments having a transverse bend therein substantially parallel to a line containing said points of said teeth.

6. A roll towel dispenser as set forth in claim 1, wherein said first and second guide rollers each include a plurality of said annular grooves to which a plurality of said guide clips are connected.

7. A roll towel dispenser as set forth in claim 6, wherein said guide clips bias said first and second guide rollers toward the drive roller.

8. A roll towel dispenser as set forth in claim 6, wherein said cutting blade defines a plurality of blade slots through which said guide clips extend as said cutting blade rotates through said slot in said drive roller.

9. A roll towel dispenser as set forth in claim 6, wherein said frame defines guide clip positioners engaging said guide clips to support said guide clips in a predetermined vertical orientation.

10. A roll towel dispenser as set forth in claim 6, wherein said guide clips and said drive roller are located to provide a gap of about 1/16" to about 1/8" therebetween.

11. A roll towel dispenser as set forth in claim 6, wherein said frame and said drive roller block access to said cutting blade when said front housing is in an open position from said rear housing.

12. A roll towel dispenser as set forth in claim 6, further comprising:

a plurality of annular slots defined in said drive roller;

a plurality of fins projecting from said front housing into said annular slots, said fins stripping the web from said drive roller and guiding the web to said dispensing slot.

13. A roll towel dispenser as set forth in claim 1, further configured to maintain therein both a first roll of towel and a second roll of towel.

14. A roll towel dispenser as set forth in claim 13, further comprising an automatic transfer system operative to feed a tail of said first roll to said drive roller when said second roll has been exhausted to a predetermined extent.

15. A roll towel dispenser as set forth in claim 14, wherein said automatic transfer system comprises:

(a) a pair of first rocker arms pivotally mounted at opposite ends of said cutting blade support member, each of said first rocker arms including a sensor support member and a gear member;

(b) a sensing means affixed to each of said sensor support members and spanning therebetween;

(c) a pair of second rocker arms pivotally mounted to the frame at opposite sides thereof, each of said second rocker arms including a transfer rod support member and a geared surface, each of said geared surfaces meshing with one of said gear members;

(d) a transfer rod affixed to each of said transfer rod support members and spanning therebetween;

(e) means for attaching the tail of the second roll of towel to said transfer rod; and (f) biasing means for biasing said sensing means against an outside surface of said first roll of towel such that as the first roll is depleted, said sensing means remains in contact with the outside surface of said first roll of towel, the resulting rotational movement of said first pair of rocker arms driving rotation of said second pair of rocker arms through the interaction of said geared surfaces with said gear members thereby moving said transfer rod and the tail of the second roll of towel toward said first nip, the tail of the second roll of towel being delivered to said first nip when said first roll has exhausted to said predetermined extent.

16. A roll towel dispenser as set forth in claim 1, further comprising a braking mechanism operative to provide a positive stop to said drive roller when a predetermined length of web has been withdrawn by a user.

17. A roll towel dispenser as set forth in claim 16, wherein said braking mechanism comprises:

(a) a jumping cam affixed to said spur gear, said jumping cam including one radial step;

(b) a pair of brackets extending from said frame proximate to said spur gear;

(c) a shock absorbing member mounted between said brackets and adapted for intermittent, bidirectional rotational movement about an axis of said cutting blade support member, said shock absorbing member including a shaft therein;

(d) spring means biasing said shock absorbing member to a normal position;

(e) a slotted piston residing in said shaft;

(f) a cam follower projecting from said piston, said cam follower interacting with said jumping cam when the cutting blade support member is rotated such that said piston is caused to reciprocate within said shaft;

(g) a brake stop extending from said piston toward said spur gear; and (h) a gear stop extending from said spur gear toward said piston, said piston moving to a position wherein said brake stop is rammed by said gear stop after a predetermined length of web has been extracted by a user thereby interfering with further rotational movement of said spur gear and thereby preventing the user from causing the web to free spool from the dispenser, said jumping cam then allowing the piston to fall within the shaft moving such that said brake stop no longer interferes with gear stop allowing the user to extract another predetermined length of web.

18. A roll towel dispenser as set forth in claim 1, wherein said drive roller is rotatably supported along a first longitudinal axis and said cutting blade support member is rotatably supported along a second longitudinal axis, said second longitudinal axis being located more rearward in said compartment and at least as far as said first longitudinal axis from a bottom portion of said housing.

19. A roll towel dispenser for delivering and severing sheets of web from a roll of towel comprising:

(a) a housing defining a compartment in which the roll of towel is maintained;

(b) means for supporting the roll of towel in said compartment;

(c) a frame attached to said housing;

(d) a drive roller rotatably supported on said frame;

(e) cutting means mechanically interconnected with said drive roller for severing a sheet of web from the roll of towel, said sheet having a predetermined length;

(f) a first guide roller supported by said frame and a second guide roller supported by said frame, said first guide roller forming a first nip with said drive roller, said second guide roller forming a second nip with said drive roller, said drive roller being driven by the action of a user pulling on a tail of the roll of towel passing through said first and second nips and extending from said housing;

(g) a plurality of annular grooves in said first guide roller and a plurality of annular grooves in said second guide roller, said annular grooves in said first guide roller aligning with respective of said annular grooves in said second guide roller; and (h) a plurality of guide clips attached to said first and second guide rollers at said annular grooves, each of said guide clips encircling a peripheral segment of the drive roller, said guide clips biasing the first and second guide rollers toward the drive roller, said guide clips assisting in threading the roll towel through said first and second nips.

20. A web guide system for defining a web travel path in a dispenser, the web guide system comprising:

(a) a drive roller rotatably mounted within said dispenser;

(b) a first guide roller and a second guide roller rotatably mounted within the dispenser to form respective first and second nips with said drive roller;

(c) a plurality of annular grooves in first guide roller and a plurality of annular grooves in said second guide roller, said annular grooves in said first guide roller aligning with said annular grooves in said second guide roller; and (d) a plurality of guide clips attached to said first and second guide rollers at said annular grooves, each of said guide clips encircling a peripheral segment of said drive roller to define the web travel path.

21. A web system as set forth in claim 20, wherein said guide clips bias said first guide roller and said second guide roller toward said drive roller.

* * * * *